US006745836B2

(12) United States Patent
Taylor et al.

(10) Patent No.: US 6,745,836 B2
(45) Date of Patent: Jun. 8, 2004

(54) DOWN HOLE MOTOR ASSEMBLY AND ASSOCIATED METHOD FOR PROVIDING RADIAL ENERGY

(76) Inventors: Jeff L. Taylor, 100 Lynwood Dr., Houma, LA (US) 70360; Mark A. Taylor, 104 Jennifer Cir., Houma, LA (US) 70360

( * ) Notice: Subject to any disclaimer, the term of this patent is extended or adjusted under 35 U.S.C. 154(b) by 0 days.

(21) Appl. No.: 10/142,810

(22) Filed: May 8, 2002

(65) Prior Publication Data

US 2003/0209351 A1 Nov. 13, 2003

(51) Int. Cl.[7] ..... E21B 4/06; E21B 31/107

(52) U.S. Cl. ..... 166/301; 166/374; 166/240; 166/178; 175/106; 175/189; 175/306; 175/299; 175/296

(58) Field of Search ..... 166/240, 301, 166/178, 374, 319, 334.1, 332.1; 175/297, 296, 298, 299, 306, 293, 106, 173, 189

(56) References Cited

U.S. PATENT DOCUMENTS

| | | | | | |
|---|---|---|---|---|---|
| 2,029,609 | A | * | 2/1936 | Burns et al. | 175/294 |
| 2,120,240 | A | * | 6/1938 | Chappell | 175/248 |
| 2,742,265 | A | * | 4/1956 | Snyder | 175/56 |
| 3,057,418 | A | * | 10/1962 | Koppl | 175/294 |
| 3,200,895 | A | * | 8/1965 | Womack | 175/299 |
| 3,837,414 | A | * | 9/1974 | Swindle | 175/299 |
| 4,333,542 | A | | 6/1982 | Taylor | |
| 4,408,670 | A | * | 10/1983 | Schoeffler | 175/298 |
| 4,452,307 | A | * | 6/1984 | Horton | 166/174 |
| 4,462,471 | A | * | 7/1984 | Hipp | 175/296 |
| 4,463,815 | A | * | 8/1984 | Jurgens et al. | 175/302 |
| 4,573,536 | A | * | 3/1986 | Lawrence | 166/373 |
| 4,665,998 | A | * | 5/1987 | Burton | 175/299 |
| 4,667,742 | A | * | 5/1987 | Bodine | 166/301 |
| 4,705,118 | A | * | 11/1987 | Ennis | 175/65 |
| 4,844,157 | A | | 7/1989 | Taylor | |
| 4,846,273 | A | | 7/1989 | Anderson et al. | |
| 4,889,198 | A | | 12/1989 | Buck | |
| 4,919,219 | A | | 4/1990 | Taylor | |
| 5,022,473 | A | | 6/1991 | Taylor | |
| 5,069,282 | A | | 12/1991 | Taylor | |
| 5,085,479 | A | | 2/1992 | Taylor | |
| 5,156,211 | A | * | 10/1992 | Wyatt | 166/301 |
| 5,156,223 | A | * | 10/1992 | Hipp | 175/296 |
| 5,219,027 | A | | 6/1993 | Taylor | |
| 5,269,374 | A | | 12/1993 | Taylor | |
| 5,337,829 | A | | 8/1994 | Taylor | |
| 5,673,754 | A | | 10/1997 | Taylor | |
| 5,875,842 | A | * | 3/1999 | Wyatt | 166/178 |
| 5,918,690 | A | * | 7/1999 | Hailey | 175/298 |
| 6,062,324 | A | * | 5/2000 | Hipp | 175/296 |
| 6,488,105 | B1 | * | 12/2002 | Wilcox | 175/298 |
| 6,533,037 | B2 | * | 3/2003 | Eslinger et al. | 166/319 |
| 6,543,556 | B1 | * | 4/2003 | Anderson | 175/293 |

* cited by examiner

*Primary Examiner*—David Bagnell
*Assistant Examiner*—Thomas S Bomar
(74) *Attorney, Agent, or Firm*—Roy, Kiesel, Keegan & DeNicola

(57) ABSTRACT

The down hole motor is a self-contained radial drive unit that is driven by a linear input, which can be supplied from various sources. As linear motion is applied to the input of the tool, drive pins on a drive shaft follow a helical path, converting the linear motion into radial motion at the attached mandrel end. This may then be utilized in various activities such as drilling, boring and obstruction removal. This tool may also be used in conjunction with jarring mechanisms in order to create an impact drilling device, or a percussion motor.

33 Claims, 5 Drawing Sheets

DOWN HOLE MOTOR ASSEMBLY AND ASSOCIATED METHOD FOR PROVIDING RADIAL ENERGY

BACKGROUND OF THE INVENTION

The present invention relates to down hole fishing and drilling operations, or removing obstructions to a drilling line when such a line becomes lodged or otherwise stuck in the well bore. Conventional means of down hole retrieval are dubious, and usually involve attempting to actuate the entire work string in the hope of dislodging it or removing an obstruction. Often this is unsuccessful either because the work string cannot jar loose the obstructions, or adequate motion cannot be effected in the well bore. Consequences of this failure to remove the obstruction can be failure of the well to produce at all or in part, also, older methods of removing obstructions can result in line breakage, both of which result in having to relocate the drilling operation, which necessarily involves lost time and money.

The present invention is able to drive various tools in a well bore that require a radial input, and if so configured, deliver jarring forces simultaneously. The invention can also actuate a lodged object in the path of the drilling path without moving the work string, which results in reduced trauma and friction and prevents work hardening of the work string. The tool can also have various other applications, such as drilling, retrieving or driving other tools that may be attached to it, or in any application, down hole or otherwise, that may require such a jarring, oscillating, jarring or drilling action.

OBJECTS OF THE INVENTION

One objective of this invention is to provide a device capable of maintaining the bind on a drilling work line while dislodging an object, which may be interfering with the drilling operation.

Another objective of the invention is to provide a device which is more efficient at dislodging obstructions interfering with drilling operations.

Still another objective of this invention is to provide a tool that can be operated in a well bore or other confined space and supply a radial input for various needs, such as drilling, driving and jarring.

Other objects and advantages of this invention shall become apparent from the ensuing descriptions of the invention.

SUMMARY OF THE INVENTION

According to the present invention, the down hole motor is a self-contained radial drive unit that is driven by a linear input, which can be supplied from various sources. As linear motion is applied to the input of the tool, drive pins on a drive shaft follow a helical path, converting the linear motion into radial motion at the attached mandrel end. This may then be utilized in various activities such as drilling, boring and obstruction removal. This tool may also be used in conjunction with jarring mechanisms in order to create an impact drilling device, or a percussion motor.

DESCRIPTION OF THE DRAWINGS

The accompanying drawings illustrate a preferred embodiment of this invention. However, it is to be understood that this embodiment is intended to be neither exhaustive, nor limiting of the invention. They are but examples of some of the forms in which the invention may be practiced.

DETAILED DESCRIPTION OF THE PREFERRED EMBODIMENT

Figure 1A:
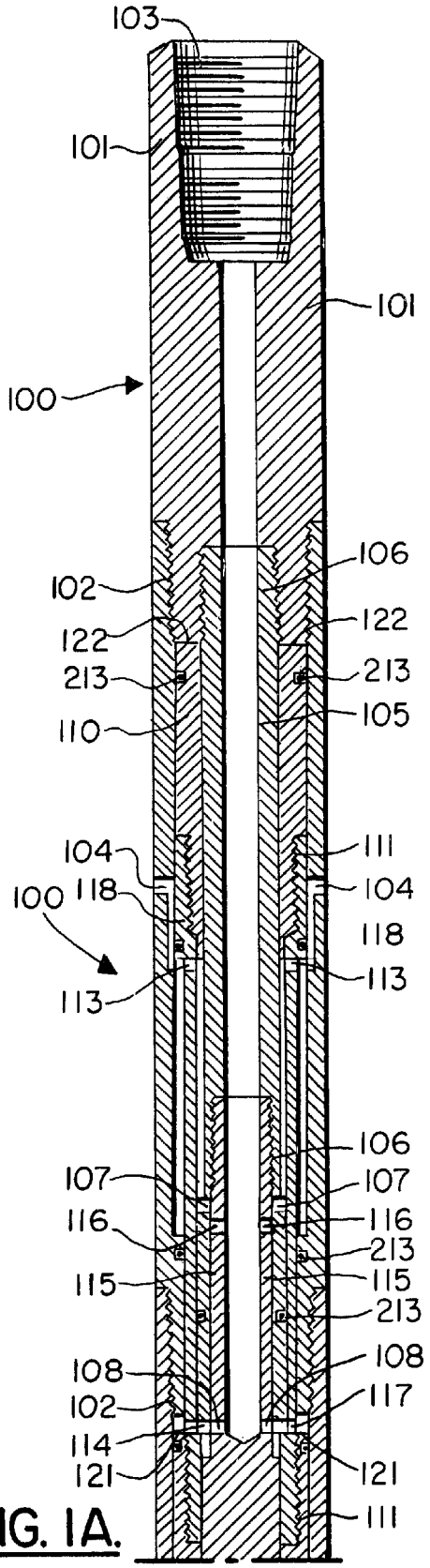
FIGS. 1A–1D show diametrical longitudinal cross-sections of the down hole motor assembly.
Figure 1B:
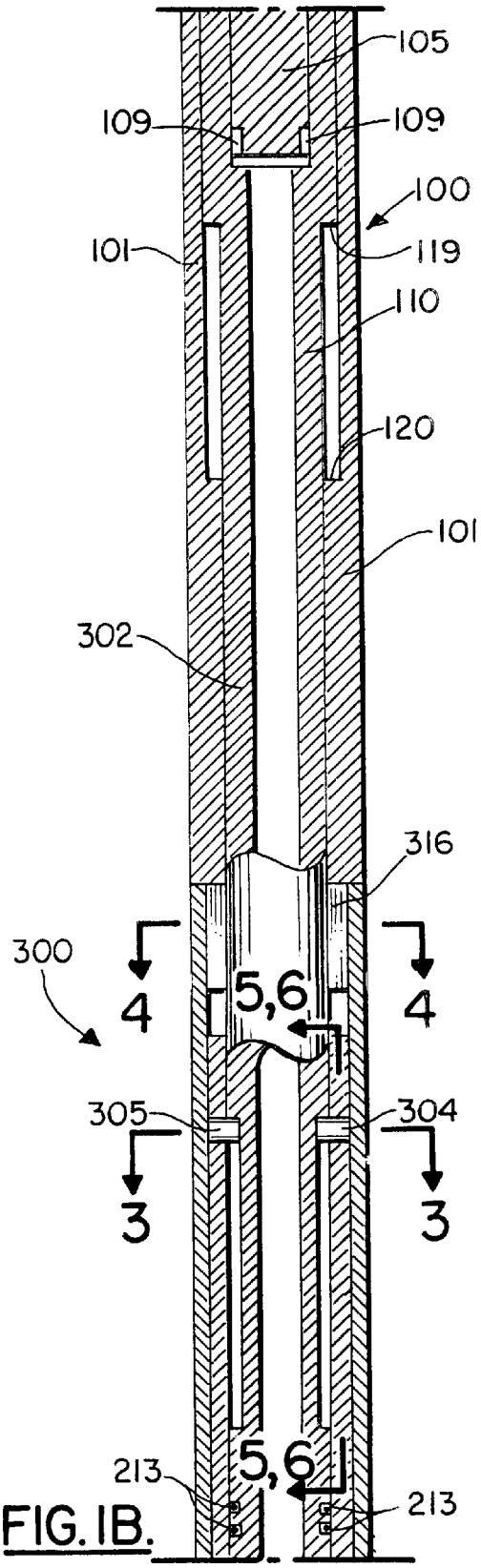
Figure 1C:
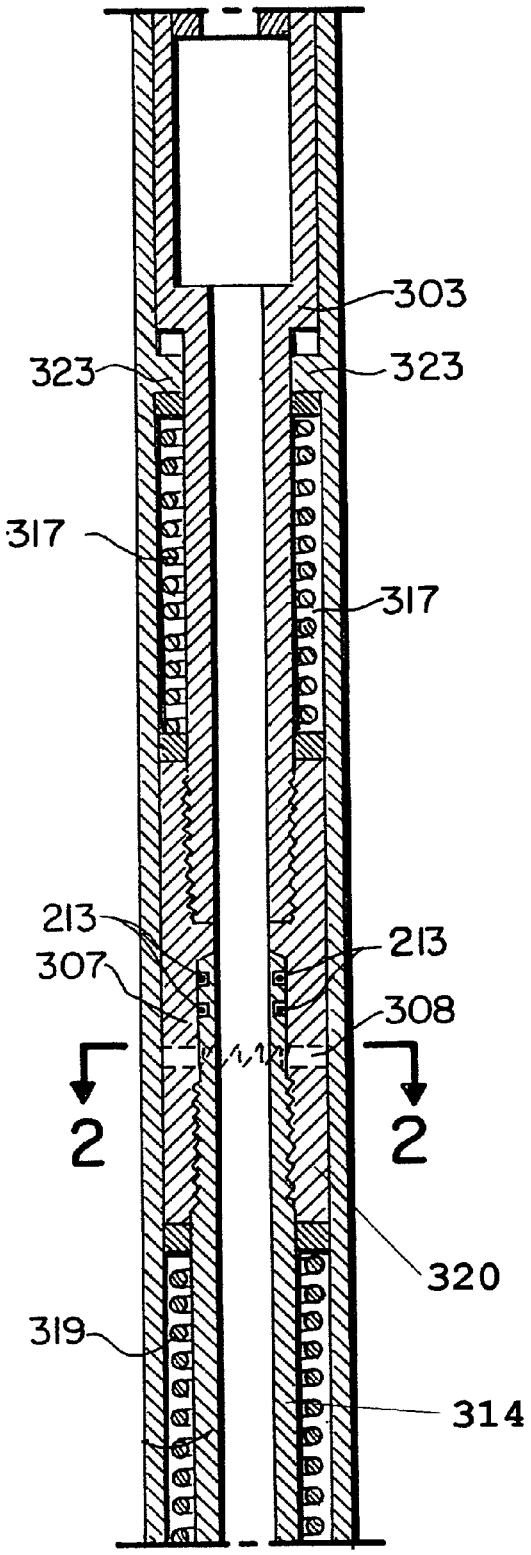
Figure 1D:
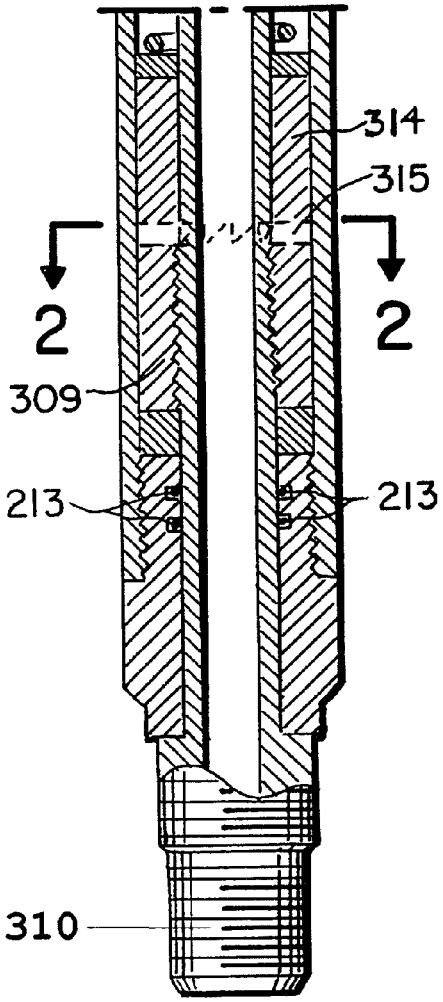
Figure 2:
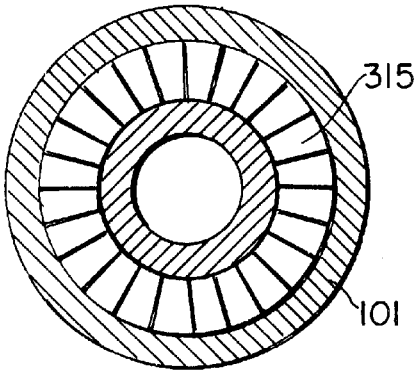
FIG. 2 shows an end cross-sectional view of the gear teeth shown in FIGS. 1C and 1D.
Figure 4:
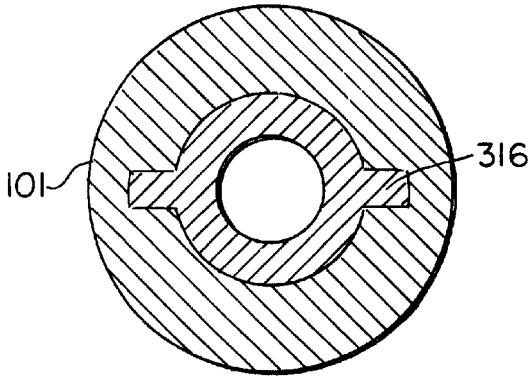
FIG. 4 shows an end cross-sectional view of the spline shown in FIG. 1B.
Figure 3:
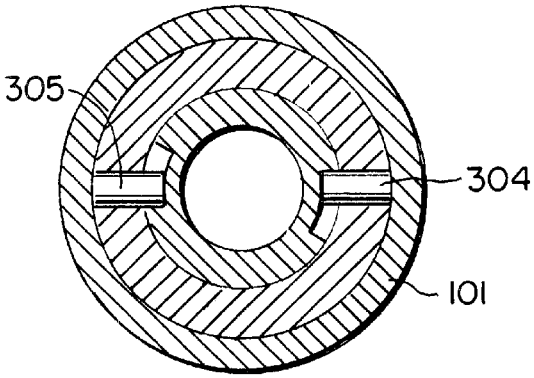
FIG. 3 shows an end cross-sectional view of the drive pins shown in FIG. 1B.
Figure 5:
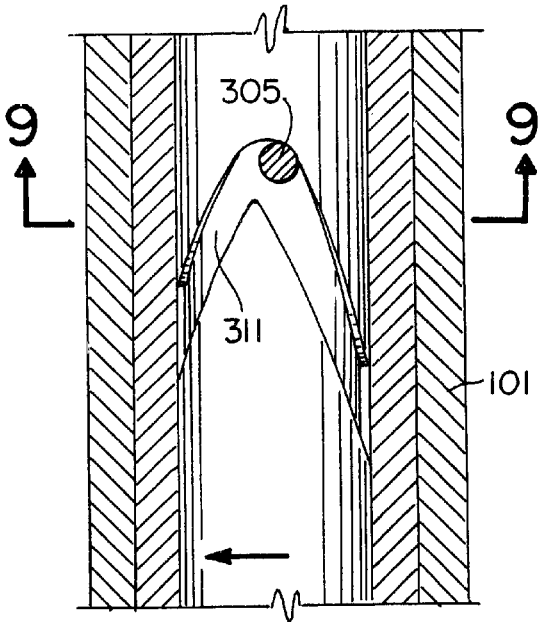
FIG. 5 shows a side cross-sectional view of the continuous cam assembly shown in FIG. 1B.

Without any intent to limit the scope of this invention, reference is made to the figures in describing the preferred embodiments of the invention. Referring to FIGS. 1 through 9, outer mandrel 101 is used to house and protect the inner workings of down hole motor assembly 300. Reciprocating drive shaft 302 lies within outer mandrel 101, and is permitted to move longitudinally within. Reciprocating drive shaft 302 may be attached on one end to a driving input, such as a flow-activated valve assembly 100, as discussed in more detail below, or any other linear input, while the opposite end of reciprocating drive shaft 302 is operatively connected with upper rotating mandrel 303 in order to convert the linear input into radial motion. Reciprocating drive shaft 302 may also be hollow if it is intended to be used with a hydraulic driving tool, which may require exhaust of hydraulic or other fluid through the center of the tool. To prevent or limit movement of upper rotating mandrel 303 and to contain the parts aft of upper rotating mandrel 303, a shoulder 323 may be employed along the surface of the inner diameter of outer mandrel 101.

Upper rotating mandrel 303 fits within outer mandrel 101, but also around reciprocating drive shaft 302. Upper rotating mandrel 303 engages reciprocating drive shaft 302, which has radial grooves on the surface of its outer diameter, as pictured in FIG. 5 and in detail in FIG. 8. Grooves 311 are radially cut in a fashion which, as linear input is provided, provides a continuous linear to radial conversion, discussed further below.

Reciprocating drive shaft 302 has a plurality of bores 304 drilled into it, whereby drive pins 305 may be inserted through both reciprocating drive shaft's 302 bores and into grooves 311 of reciprocating drive shaft 302. Once pins 305 are inserted, assembly 300 is placed within, and drive pins 305 are held in place by, outer mandrel 101. This coupling of drive pins 305 in grooves 311 provides the operative connection that converts linear to radial motion. Upper spline connection 316 may be employed on a portion of reciprocating drive shaft 302 to prevent the introduction of any unintended radial motion into the linear movement of reciprocating drive shaft 302. Upper spline connection 316 is illustrated in greater detail in FIG. 4.

Upper rotating mandrel 303 is operatively connected to upper gear 306, either by a threadable connection, some other affixation, or may be cast as a single unit so that they maintain mechanical communication. On the end of upper gear 306 opposite this connection is a gear face 307 that faces a complimentary gear face 308 on lower gear 309. Lower gear 309 is operatively connected to lower rotating mandrel 310, either threadably or otherwise to maintain mechanical communication. Lower rotating mandrel 310 is then attached to whatever tool or device that is sought to be driven with radial energy.

Upper gear 306, upper gear face 307, lower gear 309 and lower gear face 308 serve to prevent reverse torque from being applied to upper rotating mandrel 303 and other parts on up through the tool. If a rotational motion opposite to that being driven is applied to lower rotating mandrel 310, lower gear 309 will freely rotate without engaging upper gear 306, since gear faces 307 and 308 are configured to drive in only one direction.

Figure 6:
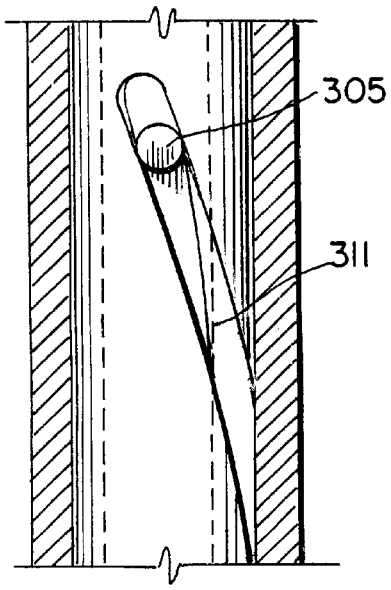
FIG. 6 shows a side cross-sectional view of a single stroke cam assembly.
Figure 7:
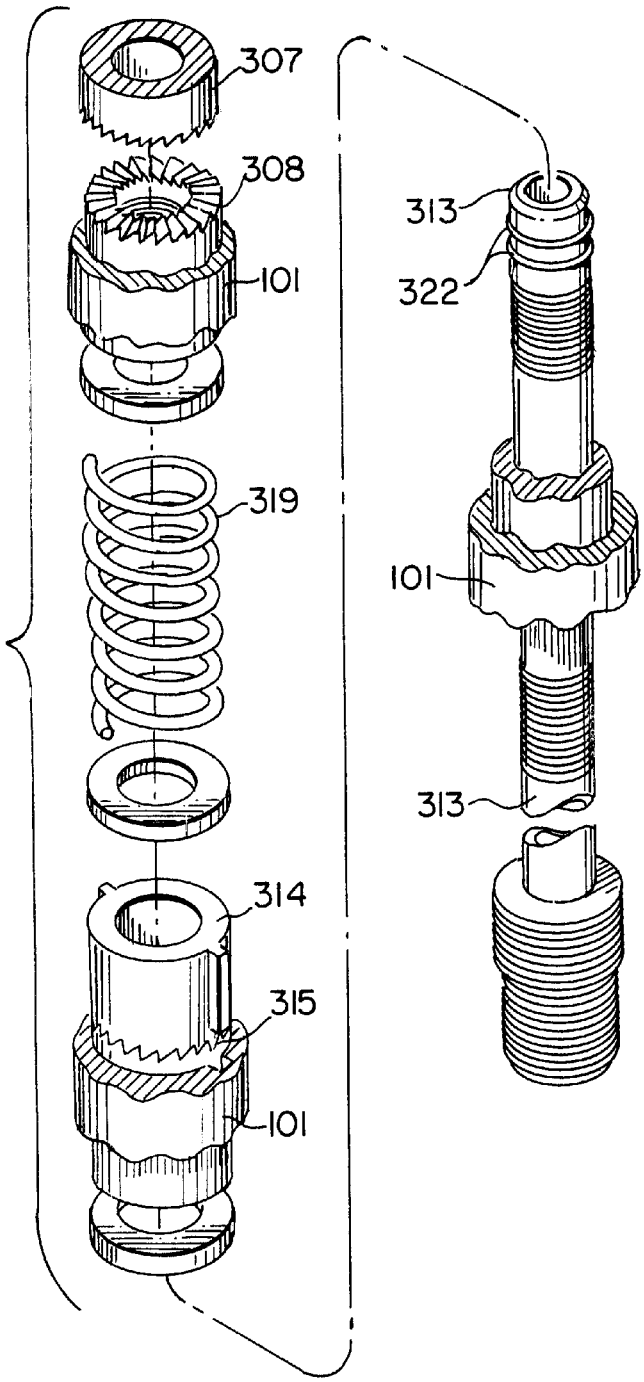
FIG. 7 shows an exploded view of the motor assembly shown in FIGS. 1A–1D.
Figure 8:
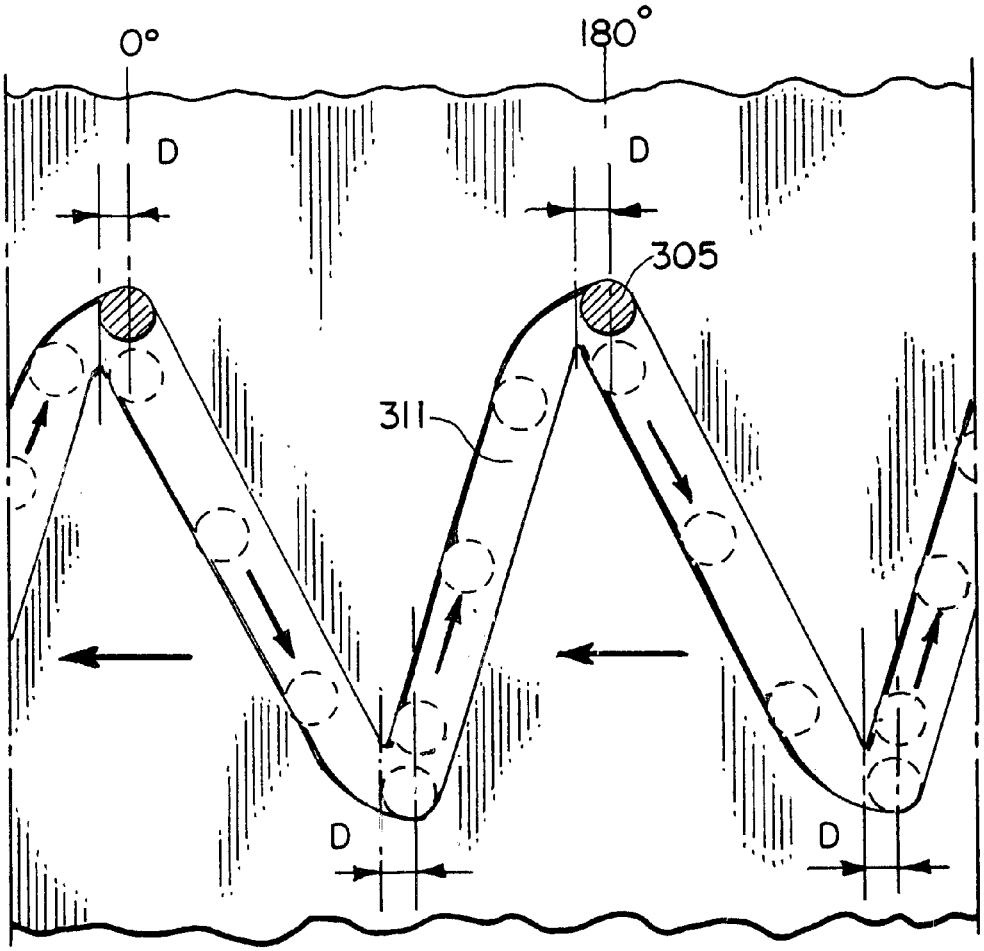
FIG. 8 shows a cutaway view of the spline groove and guide pins shown flat for illustration.
Figure 9:
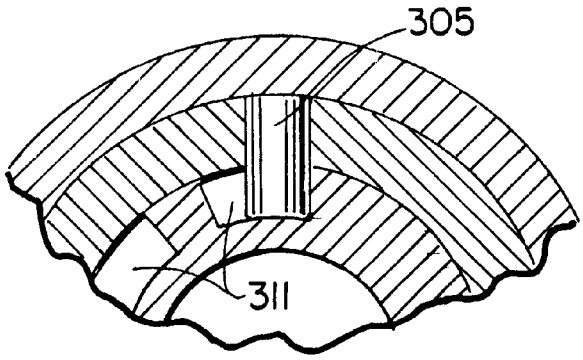
FIG. 9 shows a detailed end view of the drive pins in the helical grooves shown in FIG. 8.

In an another embodiment, a different groove pattern can be employed on reciprocating drive shaft 302, such as the one pictured in FIG. 6. Upper rotating mandrel 303 engages reciprocating drive shaft 302 which has radial grooves 311 on the surface of its outer diameter, as pictured in FIG. 6. Grooves 311 are radially cut in a fashion which, as linear input is provided, provides a linear to radial conversion on each down stroke, as discussed further below. On the return, or upstroke, however, the radial direction is reversed, thus a full up and down stroke yields an agitating action, such as that provided by an agitator of a typical clothes washer. This method can be coupled with an additional set of gears and rotating mandrel, such as middle gear 313 and middle rotating mandrel 314 to accomplish single-stroke, rather than constant radial motion.

Between upper gear 306 and upper rotating mandrel 303 lies a ratcheting assembly, comprising upper kinetic energy sleeve 317, which serves to maintain downward force on upper gear 306. This force keeps upper gear 306 in constant communication with middle gear 320 or with lower gear 309, depending upon which embodiment of the invention is employed. Middle gear 320, if employed, is operatively affixed to middle rotating mandrel 314 to maintain mechanical communication between the two.

In either embodiment, affixed to lower rotating mandrel 310 is lower gear 308, which utilize a lower spline to prevent unwanted reverse rotation on lower rotating mandrel 310. Between lower rotating mandrel 310 and or lower spline, if employed, and middle gear 320 is lower kinetic energy sleeve 319 that may be comprised of a mechanical kinetic energy store, such as a spring or other mechanical means, or a compressible gas or fluid. Lower kinetic energy sleeve 319 also assists in maintaining upward force on middle gear 320, thus keeping upper gear 306 and middle gear 320 in constant communication and engagement with one another, thus preventing it from reversing rotational direction, since the gear faces permit travel in one direction only. These methods prevent reverse torque from being applied to the internal parts of the tool, and prevent lower rotating mandrel 310 from reversing rotational direction.

In any embodiment, o-rings 213 may be strategically placed throughout the tool to prevent fluid or other materials that may be passing through or around the tool from entering moving part areas of the tool. It is also important to note that many of these component parts may be cast in single units, if desired, thus reducing the number of discrete parts in the tool. Additionally, the multiple gears 306, 308 and 320 may be configured to generate higher or lower ratios per iteration of reciprocating drive shaft 302, thus generating higher or lower revolutions per minute at the output end, as desired.

In operation, when linear input is applied to reciprocating drive shaft 302 it moves downward toward the end of down hole motor assembly 300, and drive pins 305 move downward within grooves 311. Since reciprocating drive shaft 302 is prevented from turning within outer mandrel 101 by upper spline 316, as drive pins 305 move downward, pins 305 follow grooves 311 and the upper rotating mandrel 303 turns in response. As this radial motion occurs, upper gear 306 rotates by virtue of its operative connection. Upper gear face 307 engages lower gear face 315 which rotates in kind, thereby also turning lower rotating mandrel 310, and thus whatever tool may be attached to same.

If the alternate embodiment identified above is utilized, the operation is similar, though radial motion is only delivered as reciprocating drive shaft 302 moves downward, and middle gear 313 and middle rotating mandrel 314 are employed as a ratcheting mechanism so that as reciprocating drive shaft 302 returns upward, middle gear 313 will not be engaged by upper gear 306, thus the radial motion at lower rotating mandrel 310 will not be reversed, and diminish the radial progress of the tool.

The tool can be driven by any device generating a linear input, such as the one in co-pending application entitled "Flow-Activated Valve," which is hereby incorporated by reference in its entirety. Such a tool would be attached as the driving force of down hole motor assembly 300 by being attached to reciprocating drive shaft 302. The flow-activated valve is described below.

The "top" of tool assembly 100 starts at the top of FIG. 1A. Shown is outer mandrel 101, which in the embodiment of the above-mentioned Figures, is threadably separable into several parts to facilitate assembly and maintenance by way of several threaded joints 102. The tool assembly 100 is shaped to permit connection to a hydraulic source and/or other threaded tool at joint 103. Outer mandrel 101 also has hydraulic exhaust ports 104. Located within outer mandrel 101 is the inner mandrel 105, which, in this embodiment, is threadably attached to outer mandrel 101 and is separable into parts by way of threaded connections 106. Inner mandrel 105 has hydraulic fore exhaust ports 107 and aft exhaust ports 108. Hydraulic fluid is also able to exhaust at the lower end of inner mandrel 105 through mill slots 109. These parts are all stationary while the tool is being operated.

Some of the parts of tool assembly 100 are moving while tool assembly 100 is operated, the first of which is reciprocating valve 110. Like outer mandrel 101 and inner mandrel 105, reciprocating valve 110 has, in the embodiment shown, been cast as separable pieces joined by threadable connections 111. Reciprocating valve 110 has fore hydraulic exhaust ports 113 and aft hydraulic exhaust ports 114. Various shoulders are along reciprocating valve 110 and its path of travel, such as aft hammer shoulder 119, which engages fore inner shoulder 120 of outer mandrel 101 on the down stroke. There also exists a reciprocating sleeve closing shoulder 118, and a reciprocating sleeve opening shoulder 121 which is used to actuate reciprocating sleeve 115 during operation. Outer mandrel 101 has a top shoulder 122 where outer mandrel 101 joins inner mandrel 105. Another moving part, reciprocating sleeve 115 is mounted to engage the outer portion of inner mandrel 105, and to slide back and forth along a small portion of inner mandrel 105. As in reciprocating valve 110, reciprocating sleeve 115 has fore hydraulic exhaust ports 116 and aft hydraulic exhaust ports 117.

It should be recognized that various threadable connections 111, while shown, are not essential for proper operation, and the invention can be practiced with or without threadable connections 111 on reciprocating valve 110, outer mandrel 101, or inner mandrel 105. Parts may be cast in fewer or more pieces, depending upon need and adoption for a particular use. In any embodiment, o-rings 213 may be strategically placed throughout the tool to prevent fluid or other materials that may be passing through or around the tool from entering moving part areas of the tool.

During operation, driving fluid, such as hydraulic fluid, gas or similar, is pumped or otherwise introduced into tool assembly 100 at joint 103. The fluid then passes within outer mandrel 101, to inner mandrel 105, and while tool assembly 100 is in the "up" position, the fluid will exit via aft hydraulic ports 108 of inner mandrel 105, aft hydraulic ports 114 of reciprocating sleeve 115 and aft hydraulic ports 117 of reciprocating valve 110, at which point the fluid will force reciprocating valve 110 to move away from the "top" of tool assembly 100. Eventually, reciprocating valve 110 will engage aft hammer shoulder 119, creating an impact in the downward direction, as well as marking the end of the downward stroke.

Simultaneously with the above action, reciprocating sleeve opening shoulder 121 of reciprocating valve 110, as it slides, will cause reciprocating sleeve 115 to move down the inner mandrel 105 in the same direction, effectively closing aft hydraulic ports 108 of inner mandrel 105, and opening fore hydraulic ports 107 of inner mandrel 105. At this time, the fluid will be permitted to exit via the lower end of inner mandrel 105 through mill slots 109, at which point it may exit from end 20 122. This leaves tool assembly 100 in the "down" position.

At all times during operation, additional fluid is being pumped into joint 103, but because inner mandrel 105 hydraulic aft exhaust ports 108 are now closed, the fluid exits through the inner mandrel 105 hydraulic fore exhaust ports 107, which forces reciprocating valve 110 to move in the direction of joint 103 due to fluid pressure being applied to reciprocating valve 110, that being the path of least resistance. This movement continues until reciprocating valve 110 reaches top shoulder 122, at which point reciprocating valve 110 engages top shoulder 122 and creates an impact in an upward direction, marking the end of the upward stroke. At this point, reciprocating valve 110 will have traveled far enough to expose outer mandrel's 101 hydraulic exhaust ports 104 so that fluid will exit tool assembly 100. When reciprocating valve 110 is in this position, reciprocating sleeve closing shoulder 118 will have moved reciprocating sleeve 115 to its original, or "up" position, thus restarting the cycle.

To assist in the down hole operation, accelerator 123 may be attached to bottom end of tool assembly 100 in order to exaggerate the vibratory motion created by tool assembly 100. Accelerator 123 is constructed of extending mandrel 124, which is shaped to fit within outer mandrel 101, but also to permit a compressible kinetic energy sleeve 125 to fit between the walls of outer mandrel 101 and extending mandrel 124, and further be connected to reciprocating valve. Kinetic energy sleeve 125 is retained in place by being situated between a fore accelerator shoulder 126 and an aft accelerator shoulder 127.

In this manner, when reciprocating valve 110 is performing a downward stroke, it is energizing a compressible kinetic energy sleeve 125, such as a spring, belleville washer assembly, stacked chevron washer assembly, risked washer springs, hydraulic fluid or other known similar devices. This is accomplished when fore accelerator shoulder 126 is moving downwardly and compresses kinetic energy sleeve 125. When reciprocating valve 110 reverses direction, it is thrust forward with the contained kinetic energy stored in compressible kinetic energy sleeve 125, thus creating a more powerful impact on the upstroke. Similarly, compressible kinetic energy sleeve 125 can be configured to have the reverse effect, or to amplify the downward stroke. This can be done by reversing compressibility of the spring to change the direction of the release of kinetic energy.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims.

The invention claimed is:

1. A down hole motor assembly comprising:

a. an outer mandrel, b. a reciprocating drive shaft shaped to fit within said outer mandrel having helical grooves shaped to receive drive pins, c. an upper rotating mandrel operatively engaged to said reciprocating drive shaft to permit transfer of motion, d. an upper gear shaped to fit within said outer mandrel, and operatively engaged to said upper rotating mandrel to maintain mechanical communication, e. a lower gear shaped to fit within said outer mandrel and shaped to operatively engage said upper gear to provide mechanical communication, and f. a lower rotating mandrel operatively engaged with said lower gear to maintain mechanical communication.

2. The down hole motor assembly of claim 1 further comprising a plurality of bores in said upper rotating mandrel.

3. The down hole motor assembly of claim 2 further comprising said pins shaped to operatively engage said grooves in said drive shaft and which are inserted through said bores in said reciprocating drive shaft in order to drive said drive shaft.

4. The down hole motor assembly of claim 3 wherein said upper rotating mandrel is operatively engaged to maintain radial communication with said upper gear.

5. The down hole motor assembly of claim 4 wherein said upper gear further comprises a gear face on the face opposite said operative connection with said upper rotating mandrel.

6. The down hole motor assembly of claim 5 wherein said lower gear further comprises a gear face on the face closest to said upper gear shaped to operatively engage the angled teeth on said upper gear to provide mechanical communication.

7. The down hole motor assembly of claim 6 wherein said lower rotating mandrel is operatively engaged to maintain radial communication with said lower gear.

8. The down hole motor assembly of claim 7 further comprising a shoulder on the surface forming the inner diameter of said outer mandrel positioned to limit the longitudinal movement of said upper rotating mandrel.

9. The down hole motor assembly of claim 8 further comprising at least one aft spline along the end of said lower rotating mandrel closest to said lower gear.

10. The down hole motor assembly of claim 9 further comprising at least one aft spline groove in said outer mandrel shaped to receive said aft spline.

11. The down hole motor assembly of claim 10 further comprising a lower kinetic energy return sleeve positioned between said lower rotating mandrel and said aft spline of said lower rotating mandrel.

12. The down hole motor assembly of claim 11 further comprising a shoulder positioned on the inner diameter of said upper gear shaped to prevent longitudinal travel of said lower rotating mandrel past said shoulder.

13. The down hole motor assembly of claim 12 further comprising at least one fore spline groove in said outer mandrel.

14. The down hole motor assembly of claim 13 further comprising at least one fore spline on said reciprocating drive shaft which operatively engages said fore spline groove in said outer mandrel.

15. The down hole motor assembly of claim 1 further comprising a flow-activated valve with which to drive a down hole jar tool, comprising:

a. an outer mandrel adapted to be operatively engaged to provide mechanical communication with a work string;

b. a reciprocating valve shaped to fit within said outer mandrel;

c. an inner mandrel shaped to fit within said reciprocating valve and operatively engaged on one end to said outer mandrel in order to maintain relative position to said outer mandrel; and d. a reciprocating sleeve shaped to engage a portion of the surface forming the outer diameter of said inner mandrel.

16. A down hole motor assembly comprising:

a. an outer mandrel, b. a reciprocating drive shaft shaped to fit within said outer mandrel, c. an upper rotating mandrel operatively engaged to said reciprocating drive shaft to provide mechanical communication, d. an upper gear shaped to fit within said outer mandrel, and operatively engaged to said upper rotating mandrel to maintain mechanical communication, e. a middle gear shaped to fit within said outer mandrel and operatively engaged to said upper gear to provide mechanical communication, f. a middle rotating mandrel shaped to fit within said outer mandrel and is operatively engaged to said middle gear to maintain mechanical communication, g. a lower gear shaped to fit within said outer mandrel and shaped to operatively engage said middle gear to provide mechanical communication, and h. a lower rotating mandrel operatively engaged to said lower gear to provide mechanical communication.

17. The down hole motor assembly of claim 16 wherein said reciprocating drive shaft has a plurality of protruding drive pins which extend from said reciprocating drive shaft's outer diameter.

18. The down hole motor assembly of claim 17 wherein said reciprocating drive shaft has a plurality of grooves which extend helically along the surface forming the outer diameter of said reciprocating drive shaft shaped to engage said drive pins on said upper rotating mandrel.

19. The down hole motor assembly of claim 18 wherein said upper rotating mandrel is operatively engaged to maintain radial communication with said upper gear.

20. The down hole motor assembly of claim 19 wherein said upper gear further comprises a gear face on the face opposite said operative connection with said upper rotating mandrel.

21. The down hole motor assembly of claim 20 wherein said middle gear further comprises a gear face on the face closest to said upper gear shaped to operatively engage the angled teeth on said upper gear to provide mechanical communication.

22. The down hole motor assembly of claims 21 wherein said lower gear further comprises a gear face on the face closest to said middle gear.

23. The down hole motor assembly of claim 22 wherein said middle rotating mandrel has on the face closest to said lower gear angled teeth shaped to operatively engage the angled teeth on said lower gear to provide mechanical communication.

24. The down hole motor assembly of claim 23 further comprising a shoulder on the inner diameter of said outer mandrel positioned to limit the longitudinal movement of said upper rotating mandrel.

25. The down hole motor assembly of claim 24 further comprising an upper kinetic energy return sleeve positioned between said upper gear and said shoulder of said outer mandrel.

26. The down hole motor assembly of claim 25 further comprising at least one aft spline along the end of said middle rotating mandrel closest to said lower gear.

27. The down hole motor assembly of claim 26 further comprising at least one aft spline groove in said outer mandrel shaped to receive said aft spline.

28. The down hole motor assembly of claim 27 further comprising a lower kinetic energy return sleeve positioned between said middle gear and said aft spline of said middle rotating mandrel.

29. The down hole motor assembly of claim 28 further comprising a shoulder positioned on the inner diameter of said upper gear shaped to prevent further longitudinal travel of said middle rotating mandrel past said shoulder.

30. The down hole motor assembly of claim 29 further comprising at least one fore spline groove in said outer mandrel.

31. The down hole motor assembly of claim 30 further comprising at least one fore spline on said reciprocating drive shaft which operatively engage said fore spline groove in said outer mandrel to maintain relative position.

32. The method of providing radial energy utilizing a down hole motor comprising an outer mandrel, a reciprocating drive shaft, an upper gear, a lower gear, an upper rotating mandrel, and a lower rotating mandrel comprising, attaching a top end of a down hole motor to a work string, attaching a bottom end of said down hole motor to a device requiring a radial input, and applying linear input to said reciprocating drive shaft.

33. The method of claim 32 further comprising the step of driving said down hole motor using a flow-activated valve comprising an outer mandrel adapted to be operatively engaged with a work string to maintain mechanical communication, a reciprocating valve shaped to fit within said outer mandrel, an inner mandrel shaped to fit within said reciprocating valve and operatively engaged on one end to said outer mandrel to maintain relative position, and a reciprocating sleeve shaped to engage a portion of the surface forming the outer diameter of said inner mandrel.

* * * * *